US005971562A

United States Patent [19]

Yang

[11] Patent Number: 5,971,562

[45] Date of Patent: Oct. 26, 1999

[54] TWIN HEADED FLASHLIGHT

[76] Inventor: Paul Yang, 49-1 Feng Hwa, Shin Shyn Hsiang, Taiwan

[21] Appl. No.: 09/133,087

[22] Filed: Aug. 12, 1998

Related U.S. Application Data

[63] Continuation-in-part of application No. 29/089,746, Jun. 22, 1998, Pat. No. Des. 407,515.

[51] Int. Cl.[6] ..... F21L 7/00

[52] U.S. Cl. ..... 362/184; 362/197; 362/198

[58] Field of Search ..... 362/184, 197, 362/199, 198

[56] References Cited

U.S. PATENT DOCUMENTS

| | | | |
|---|---|---|---|
| D. 180,751 | 8/1957 | Remmel | D48/25 |
| D. 249,535 | 9/1978 | Cantor | D22/1 |
| D. 308,257 | 5/1990 | Staubitz et al. | D26/49 |
| D. 349,776 | 8/1994 | Yuen | D26/37 |
| D. 363,564 | 10/1995 | Kish et al. | D26/49 |
| D. 370,989 | 6/1996 | Garrity | D26/49 |
| D. 371,855 | 7/1996 | Heun | D26/43 |
| D. 373,211 | 8/1996 | Heun | D26/44 |
| D. 373,646 | 9/1996 | Szymanski et al. | D26/37 |
| D. 380,061 | 6/1997 | Swyst | D26/43 |
| 2,427,051 | 9/1947 | Goudreau . | |
| 2,427,890 | 9/1947 | White . | |
| 2,796,516 | 6/1957 | Martschik . | |
| 3,030,497 | 4/1962 | Cheng . | |
| 4,414,612 | 11/1983 | Conforti et al. | 362/188 |
| 4,467,403 | 8/1984 | May | 362/250 |
| 4,495,550 | 1/1985 | Visciano | 362/189 |
| 5,278,739 | 1/1994 | Gammache | 362/197 |
| 5,541,822 | 7/1996 | Bamber | 362/190 |
| 5,558,430 | 9/1996 | Booty, Jr. | 362/184 |
| 5,605,394 | 2/1997 | Chen | 362/197 |
| 5,859,582 | 1/1999 | Yuen | 362/184 X |

OTHER PUBLICATIONS

Product Brochure for Doubleheader Flashlight May 1997.

*Primary Examiner*—Stephen Husar
*Attorney, Agent, or Firm*—Robert C. Kain, Jr.

[57] ABSTRACT

A twin headed flashlight includes a generally hollow, cylindrical body member with an interior body cavity sized to contain batteries which supply power to the flashlight. At one end of the cylindrical body, first and second flashlight head elements are mounted. The second flashlight head element is rotatably mounted to the cylindrical body such that the second flashlight head element can be rotated away or outboard from the axial centerline of the cylindrical body. In one mode of operation when the first and second flashlight head elements are juxtaposed near each other, a generally singular beam of light is emitted by the flashlight. In another operative mode when the second flashlight head is rotated outboard from the axial centerline, two divergent beams of light are emitted from the flashlight. Of course, the user can rotate the second flashlight head to a desired angular position within the maximum range of rotation (approximately 50 degrees from the axial centerline). In a specific embodiment, the first and second flashlight head elements include corresponding lenses that have respective, complementary mating edges. The mating lens edges are complementary to each other. Other lens shapes may be utilized.

20 Claims, 7 Drawing Sheets

TWIN HEADED FLASHLIGHT

This is a continuation in part of U.S. patent application Ser. No. 29/089,746 filed on Jun. 22, 1998, entitled "DUAL HEADED FLASHLIGHT", now U.S. Pat. No. Des. 407,515.

The present invention relates to a twin headed or dual headed flashlight wherein one flashlight head can be rotatably disposed away from the first flashlight head.

BACKGROUND OF THE INVENTION

Twin headed or dual headed flashlights and single headed flashlight with a rotating head are described in one or more of the following references: U.S. Pat. No. 5,278,739 to Gammache; U.S. Pat. No. 4,467,403 to May; U.S. Pat. No. 3,030,497 to Cheng; U.S. Pat. No. 5,605,394 to Chen; U.S. Pat. No. 5,541,822 to Bamber; U.S. Pat. No. 4,495,550 to Visciano; U.S. Pat. No. 4,414,612 to Conforti et al.; U.S. Pat. No. 2,796,516 to Martschik; U.S. Pat. No. 2,427,890 to White; U.S. Pat. No. 2,427,051 to Goudreau; U.S. Pat. No. 1,119,663 to Swallow; U.S. Pat. No. Des. 380,061 to Swyst; U.S. Pat. No. Des. 373,646 to Szymanski et al.; U.S. Pat. No. Des. 373,211 to Heun; U.S. Pat. No. Des. 371,855 to Heun; U.S. Pat. No. Des. 370,989 to Garrity; U.S. Pat. No. Des. 363,564 to Kish et al.; U.S. Pat. No. Des. 349,776 to Yuen; U.S. Pat. No. Des. 308,257 to Staubitz et al.; U.S. Pat. No. Des. 249,535 to Cantor; and U.S. Pat. No. Des. 180,751 to Renmel.

OBJECTS OF THE INVENTION

It is an object of the present invention to provide a twin headed flashlight wherein one of the flashlight heads can be rotatably positioned by the user while the other head is in a fixed, generally axially aligned, position.

It is another object of the present invention to provide a twin headed flashlight wherein, in a first operative mode, the first and second flashlight head lens elements are juxtaposed next to each other and form either a single beam of light or a unitary, combinatory beam of light and, in a second operative mode, the second flashlight head element is rotated away from the axial centerline of the unit such that two, divergent beams of light are produced by the flashlight.

It is a further object of the present invention to provide a twin headed flashlight which, in one embodiment, includes a flexible body element permitting the heads to be moved with 2 degrees of freedom.

It is an additional object of the present invention to provide interchangeable parts such that the flexible body can be added to the flashlight head segment and the battery segment.

SUMMARY OF THE INVENTION

A twin headed flashlight includes a generally hollow, cylindrical body member with an interior body cavity sized to contain batteries which supply power to the flashlight. At one end of the cylindrical body, first and second flashlight head elements are mounted. The second flashlight head element is rotatably mounted to the cylindrical body such that the second flashlight head element can be rotated away or outboard from the axial centerline of the cylindrical body. In one mode of operation when the first and second flashlight head elements are juxtaposed near each other, a generally singular beam of light is emitted by the flashlight. In another operative mode when the second flashlight head is rotated outboard from the axial centerline, two divergent beams of light are emitted from the flashlight. Of course, the user can rotate the second flashlight head to a desired angular position within the maximum range of rotation (approximately 50 degrees from the axial centerline). In a specific embodiment, the first and second flashlight head elements include corresponding lenses that have respective, complementary mating edges. The mating lens edges are complementary to each other. Other lens shapes may be utilized.

BRIEF DESCRIPTION OF DRAWINGS

Further objects and advantage of the present invention can be found in the brief description of the preferred embodiments when taken in conjunction with the accompanying drawings in which.

DETAILED DESCRIPTION OF THE PREFERRED EMBODIMENTS

The present invention relates to a twin headed flashlight.

Figure 1:
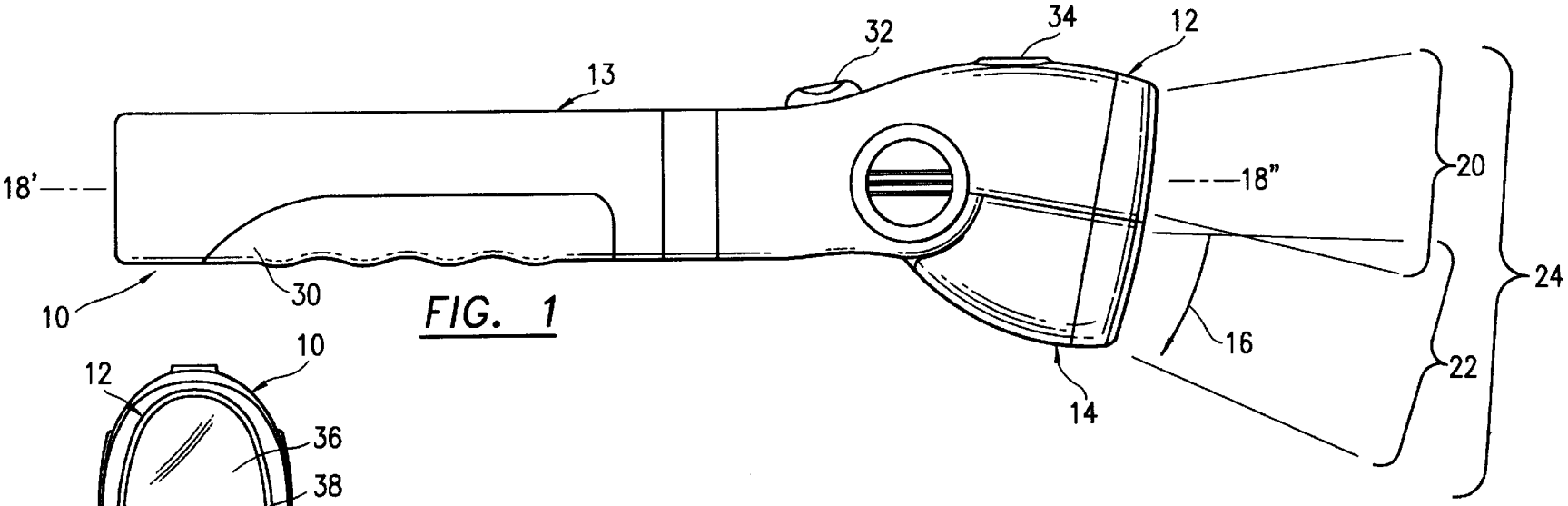
FIG. 1 diagrammatically illustrates the twin headed flashlight in the first operative mode.

FIG. 1 diagrammatically illustrates a side view of twin headed flashlight 10 in a first operative mode. In this first mode, first flashlight head element 12, which is fixed to cylindrical body member 13, is adjacent second flashlight head element 14. Head element 12 is generally axially aligned. However, in the preferred embodiment, head element 12 is slightly offset at an angle from axial centerline 18'–18". Flashlight head 14 is rotatable and is enabled to rotate in the direction shown by arrow 16 away from axial centerline 18'–18". In the first operative mode, light beam 20 from flashlight head 12 partially overlaps and integrates with light beam 22 from flashlight head 14. The combined beam 20, 22 forms a singular beam of light 24.

Additionally, twin headed flashlight 10 includes a grip region 30, a user actuatable switch 32 and a flattened head portion 34 which provides ornamental decoration and visual balance with respect to switch 32 but also provides a flat surface means to support flashlight 12 when the flashlight unit 12 inverted and flat pad 34 is placed on the ground or other level surface.

Figure 2:
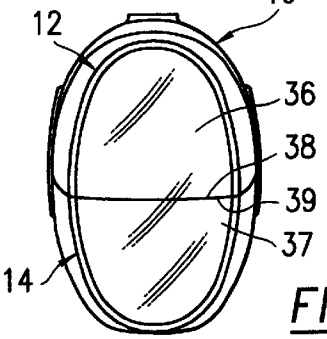
FIG. 2 diagrammatically illustrates a head-on view of the twin headed flashlight with first and second mating lens edges disposed next to each other.

FIG. 2 diagrammatically illustrates a head-on view of flashlight 10. Similar numerals designate similar items throughout all the drawings. Flashlight head 12 includes, at one end thereof, an ovoid or oval lens 36 having a singular straight edge 38. Flashlight head 14 includes an ovoid or oval lens 37 with a singular straight edge 39. Edge 38 mates with edge 39 and these edges are complementary with respect to each other.

Figure 3:
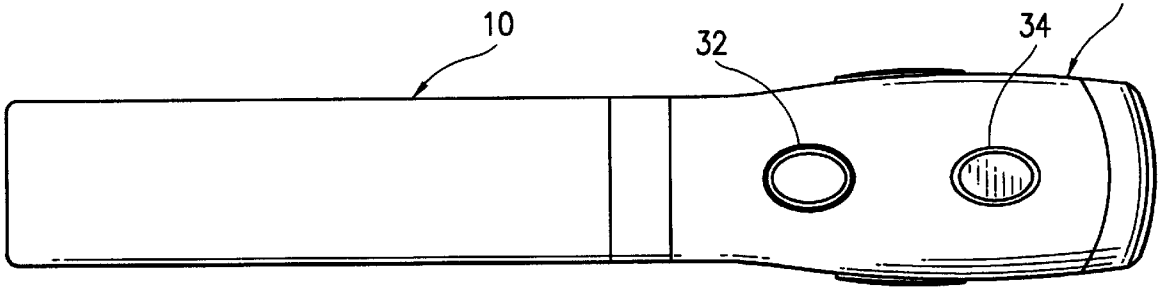
FIG. 3 diagrammatically illustrates a top view of the twin headed flashlight.

FIG. 3 is a top view of flashlight 10 showing user actuatable switch 32 and visually balancing flat region 34. Flat region 34 is disposed on the upper side of flashlight head 12.

Figure 4:
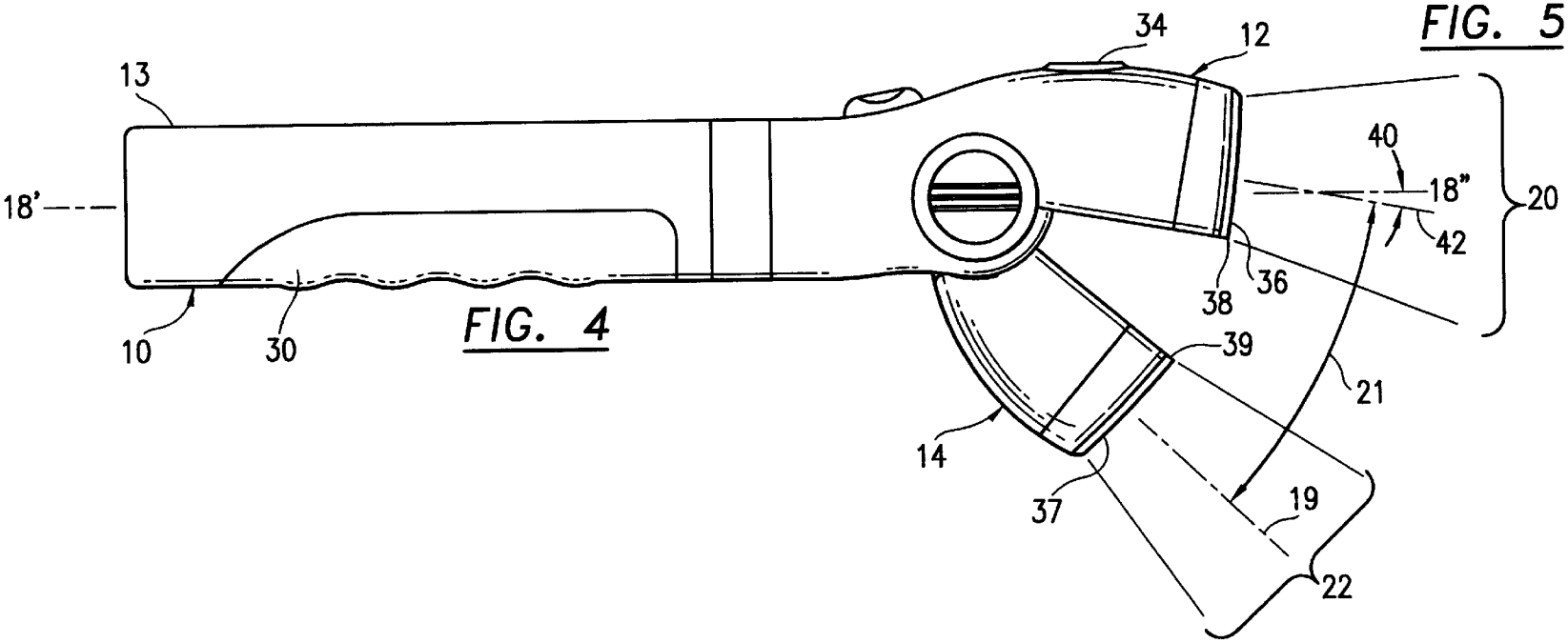
FIG. 4 diagrammatically illustrates a view of the twin headed flashlight in the second operative mode.

FIG. 4 diagrammatically illustrates a side view of twin headed flashlight 10 in a second operative mode. In this mode, the second flashlight head 14 has been rotated away from axial centerline 18'–18" and is disposed at its maximum swing angle 21 away from the axial centerline of cylindrical body member 13. In a preferred embodiment, angle 21 is at least 45 degrees. Angle 21 is computed based upon the angular displacement away from axially centerline 18'–18" and axial centerline 19 running through the second flashlight head element 14. Of course, flashlight head 14 can be placed at any angle between maximum angle 21 and the minimal angle created when lens edge 39 is adjacent lens edge 38. Additionally in a preferred embodiment, the first flashlight head element 12 is disposed at a slight offset angle 40 away from axial centerline 18'–18". Angle 40 is the angular distance between the axial centerline and flashlight head 12 centerline 42. In a preferred embodiment, offset angle 40 does not exceed 10 degrees.

In the second operative mode shown in FIG. 4, second flashlight head 14 is rotated outboard from axial centerline 18'–18" and two divergent beams of light 20, 22 are emitted from the flashlight. This enables the user to illuminate the ground as well as the items head-on as the user carries flashlight 10 generally parallel to the ground or surface level. Also, flashlight 10 can be inverted and rest plate 34 can be placed on the ground. This positioning would cause beam 20 to illuminate the ground surface while beam 22 illuminates items above the ground and within its light cone.

Figure 5:
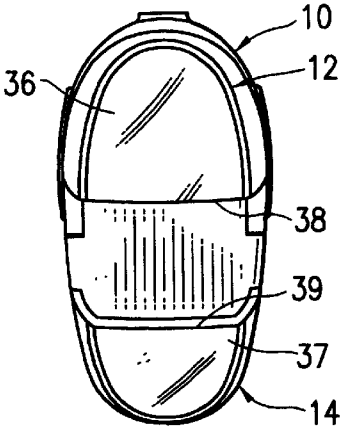
FIG. 5 diagrammatically illustrates a head-on view of the flashlight in the second operative mode.

FIG. 5 diagrammatically illustrates an end view of flashlight 10 and shows ovoid lens 36 and ovoid lens 37 spaced apart. As stated earlier, ovoid lens 36 includes a first mating edge 38 and ovoid lens 37 includes a second mating edge 39.

Figure 6:
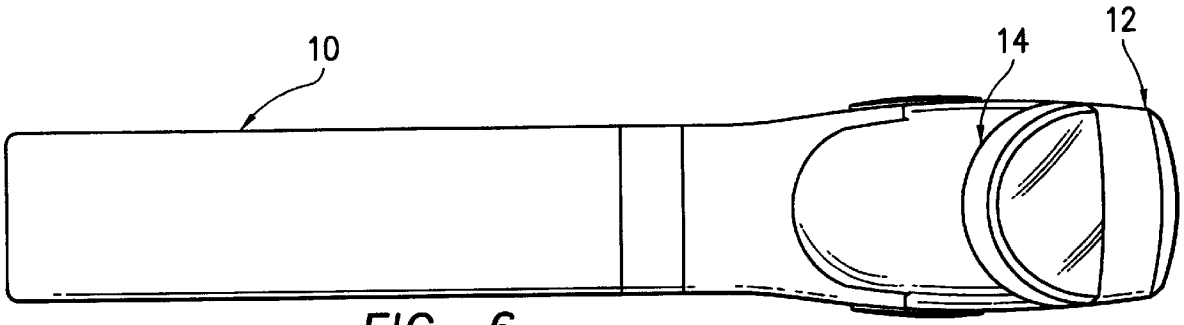
FIG. 6 diagrammatically illustrates a bottom view of the twin headed flashlight in the second operative mode.

FIG. 6 diagrammatically shows a bottom view of flashlight 10 in the second operative mode when flashlight head element 14 has been rotated outboard from the axial centerline, that is, away from the first flashlight head element 12.

Figure 7:
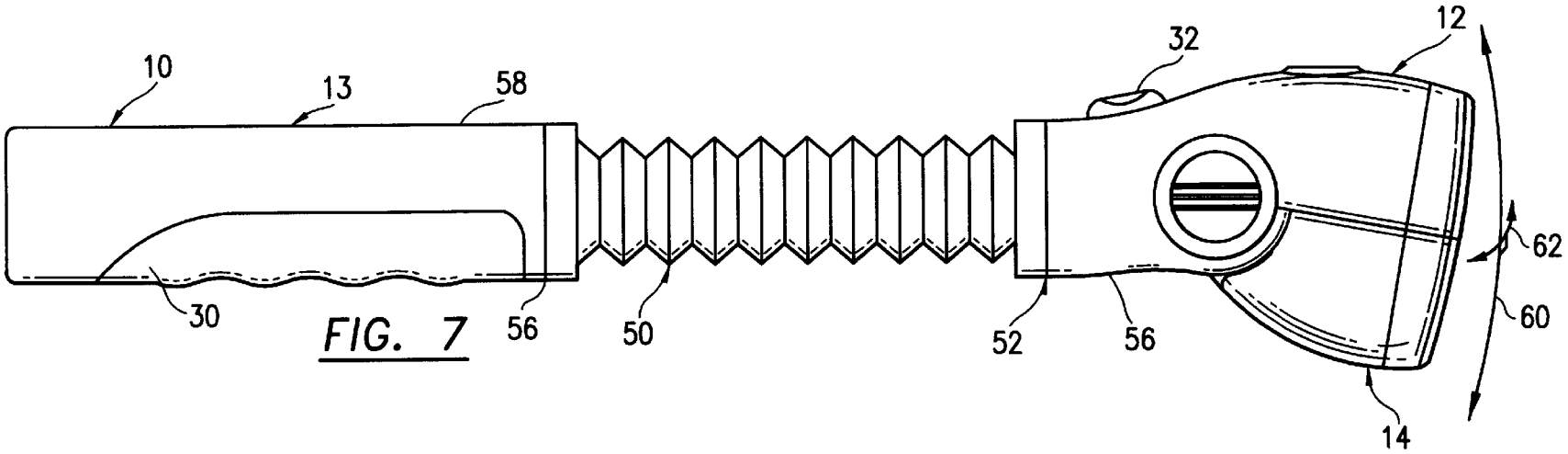
FIG. 7 diagrammatically illustrates the twin headed flashlight including a flexible body element.

FIG. 7 diagrammatically illustrates another embodiment of flashlight 10 including a flexible body element 50 interposed between cylindrical body member 13 and flashlight head elements 12, 14. As described later, flexible body element 50 is threadably attached at joints 52, 54 to a flashlight head segment 56 and a battery compartment segment 58. In this embodiment, flashlight head elements 12, 14 are mounted to flashlight head segment 56. Particularly, flashlight head 12 is fixedly mounted to flashlight head segment 56 whereas flashlight head 14 is rotatably mounted to head segment 56. Elements 12 and 56 may be integral with respect to each other. In this embodiment, switch 32 is disposed on flashlight head segment 56. In other embodiments, switch 32 may be disposed further forward on flashlight head element 12 or on battery compartment 58.

Flexible body element 50 permits two degrees of permissible motion, that is, in a direction shown by double headed arrow 60 and in the direction shown by double headed arrow 62. Arrow 62 is normal or perpendicular to arrow 60.

Figure 8:
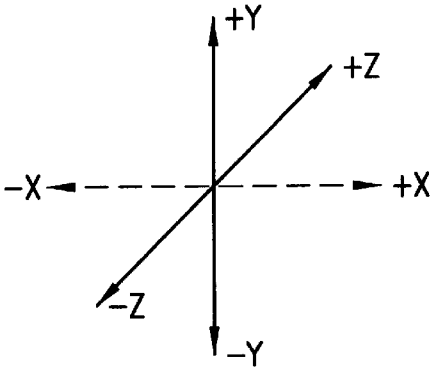
FIG. 8 diagrammatically illustrates a coordinate system showing the 2 degrees of permissible motion of the flexible body shown in FIG. 7.

As used herein, the term "two degrees" of motion refers to movement in the positive and negative y-axis and the positive and negative z-axis shown in the coordinate system of FIG. 8. Motion compressing the flexible element 50 and moving battery compartment segment 58 towards flashlight head segment 56, that is, motion in the positive x or negative x direction (FIG. 8), is not permitted. This would result in a "third degree" of motion.

Figures 9, 10:
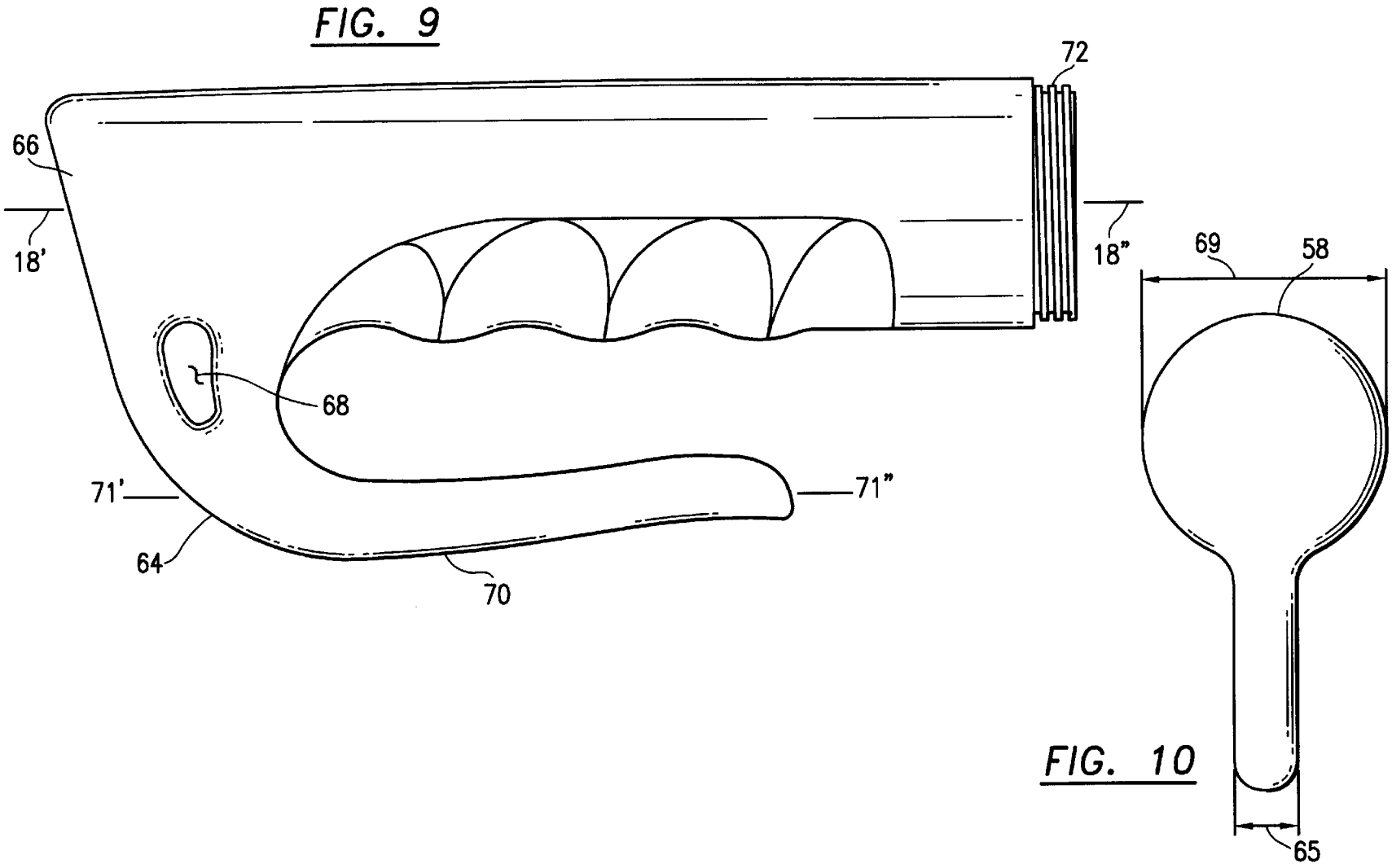
FIG. 9 diagrammatically illustrates the battery segment of the cylindrical body of the flashlight with a hook handle (the hook being an optional item)
FIG. 10 diagrammatically illustrates an end view of the flashlight with a hook handle.

FIG. 9 diagrammatically illustrates battery compartment segment 58 including a hook 64 attached to end 66. Further, a through passage 68 is provided on the handle to enable the flashlight to be hung from a pin.

FIG. 10 diagrammatically illustrates a rear end view of battery compartment segment 58 showing that hook-formed handle 64 has a narrow width 65 as compared with the width 69 of battery compartment segment 58. Further, FIG. 9 diagrammatically illustrates that hook handle 64 has a handle body 70 with a longitudinal axis 71'–71" which is generally parallel to the axial centerline 18'–18" of battery compartment segment 58. Also, battery compartment segment 58 includes a threaded end 72 which can be attached to flexible body element 50 or, in a different embodiment, attached to flashlight head segment 56.

Figure 11:
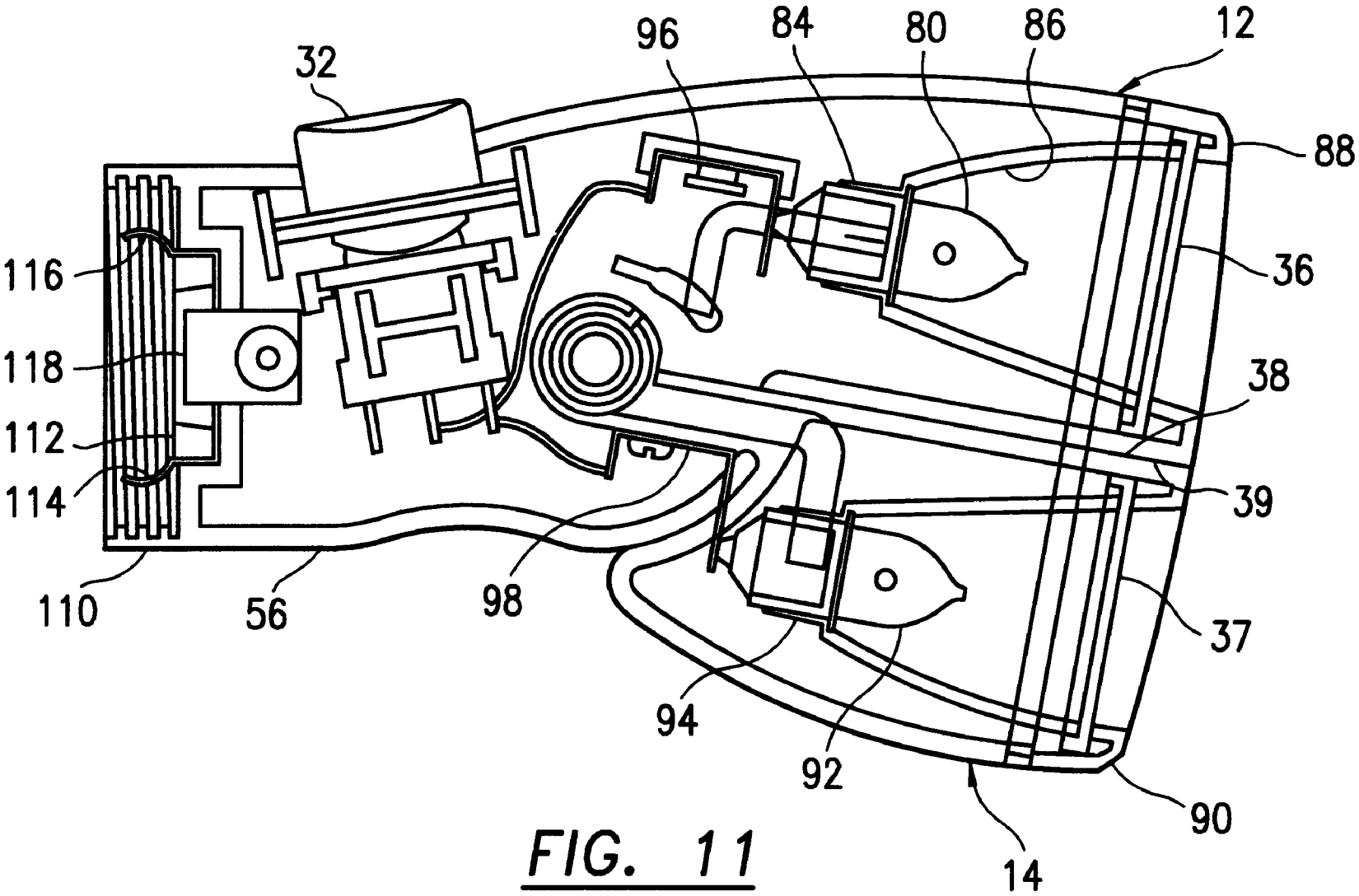
FIG. 11 diagrammatically illustrates a cross sectional view of the first and second flashlight head elements and the immediately adjacent flashlight head segment for the cylindrical body.

FIG. 11 diagrammatically illustrates major interior components of the twin headed flashlight and particularly head element 12, head element 14 and flashlight head segment 56. Head element 12 includes flashlight bulb 80 mounted in electrical socket 84. Head element 12 also includes reflective conical member 86 which is closed by flashlight lens 36. Lens 36 is held in an appropriate manner by end casing lip 88. Lip 88 includes and forms, along its lower edge, straight lens edge 38. In a like manner, ovoid lens 37 includes and is held in place by lens casing 90. Lens casing 90 forms, along its upper edge, a lens edge 39. Lens edge 38 and lens edge 39 are complementary with respect to each other and enable the projected beams of light 20, 22 from head elements 12, 14 to join together to form a single beam 24 in the first operative mode.

Second flashlight head element 14 includes bulb 92 and bulb socket 94. A reflective, conical member is disposed in head element 14. Bulb sockets 84, 94 are electrically connected via an electrical system which includes spring clip conductors 96, 98 to the electrical terminals of switch 32. At its inboard end, flashlight head segment 56 includes a threaded coupling which is, in the illustrated embodiment, a female threaded coupling 110. In addition at an interior region, head segment 56 includes a gasket 112. Further, electrical spring clips 114, 116 are part of the electrical conductive system in order to supply power between the batteries in the battery component compartment (explained later) and switch 32 and light bulbs 80, 92. Electrical conductor spring plate 118 is also disposed at the inboard end of head segment 56.

Figures 12, 13, 14:
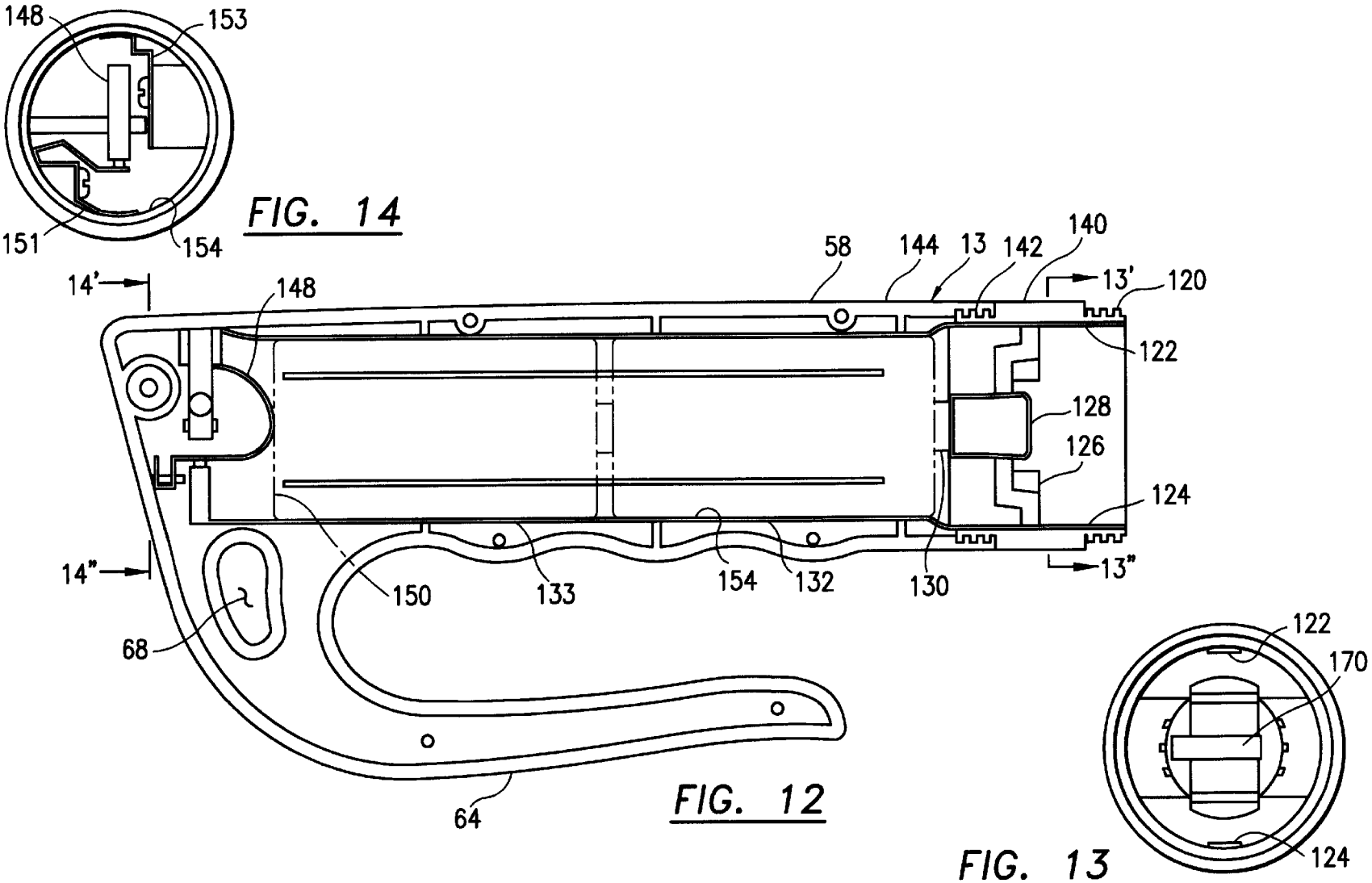
FIG. 12 diagrammatically illustrates an interior view of the cylindrical body and particularly illustrates the battery compartment segment.
FIG. 13 diagrammatically illustrates a combinatory end view of the battery compartment segment from the perspective of section line 13'–13" in FIGS. 12 and 15 wherein the battery compartment segment is threadably attached to the flexible body element.
FIG. 14 diagrammatically illustrates an interior, end view of the battery compartment segment from the perspective of section line 14'–14" in FIG. 12.

FIG. 12 diagrammatically illustrates the major interior components of battery compartment segment 58. Segment 58 is the major component of the generally hollow, cylindrical body member 13. At its inboard end, battery compartment segment 56 includes a threaded coupling which is, in this embodiment, a male threaded coupling 120, conductive plates 122, 124 and a gasket 126. An additional conductive spring plate 128 is disposed at the inboard end of battery compartment segment 58 in order to electrically connect one electrical terminal 130 of battery 132 to other electrical component members in the flashlight. In a preferred embodiment, an inboard segment 140 is threadably attached at threaded coupling 142 to battery housing 144 of battery compartment segment 58.

Two batteries 132, 133 are located in the interior of battery compartment segment 58 in a preferred embodiment. At the other end, electrically conductive spring plate 148 connects another terminal 150 of battery 133 to the other components of the electrical system.

FIG. 14 diagrammatically illustrates an interior view of battery compartment segment 58 from the perspective of section lines 14'–14" in FIG. 12. Spring element or plate 148 is attached to electrically conductive straps 151, 153. These straps are coupled to an electrical conductor 154 that extends generally along the interior wall of battery compartment segment 58. Electrical conductor 154 is ultimately connected to plates 122, 124 at the inboard end of battery compartment segment 58.

Figure 15:
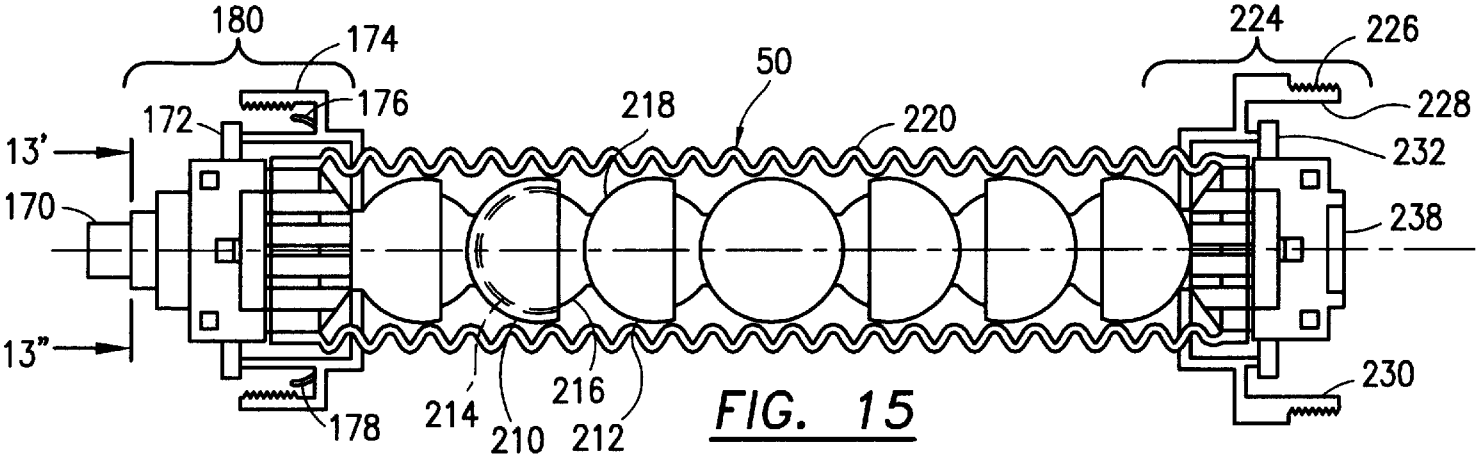
FIG. 15 diagrammatically illustrates the interior of the flexible body element.

FIG. 13 diagrammatically illustrates an interior end view from the section line 13'–13" in FIGS. 12 and 15. Outer electrical plates 122, 124 are shown in this figure as is contact member 170 from one end of flexible body element 50. See FIG. 15. Alternatively, terminal plate 128 can be coupled to terminal plate 118 (FIG. 11) by threadably attaching the two items together along with the coupler unit shown in FIG. 16 (explained later).

FIG. 15 diagrammatically illustrates the major interior components of flexible body 50. At end 180, flexible body element 50 includes contact member 170, gasket 172 and threaded coupling member 174. In the illustrated embodiment, threaded coupling 174 is a female thread. In addition, end 180 includes electrical contact prongs 176, 178 that are adapted to contact and electrically connect with contact pads 122, 124 in battery compartment segment 58 (FIG. 12). Electrical connectors from contact pads or prongs 176, 178, and separate electrical connectors or wires from contact member 170 are fed through flexible body member 50.

The interior of flexible body member 50 includes a plurality of ball and socket units, two of which are units 210 and 212. Unit 210, partially shown in dashed lines, includes a socket 214 which is closely mated to ball 216. Ball 216 is movably mounted to outer surface 218 of the socket member formed on adjacent unit 212. Additionally, a very flexible, accordion-like covering 220 covers the plurality of ball and socket units 210, 212 and provides the outer covering for flexible body element 50.

At end 224, a threaded coupling 226 (a male coupling in this embodiment), is adapted to closely fit and mate with threaded coupling 110 on flashlight head segment 56 (FIG. 11). Additionally, contact plates 228, 230 are adapted to electrically connect with contact prongs 114, 116 in flashlight head segment 56. A gasket 232 is adapted to mate with gasket 212 in head segment 56. A central contact plate 238 is adapted to electrically connect with contact member 118 on head segment 56.

Figure 16:
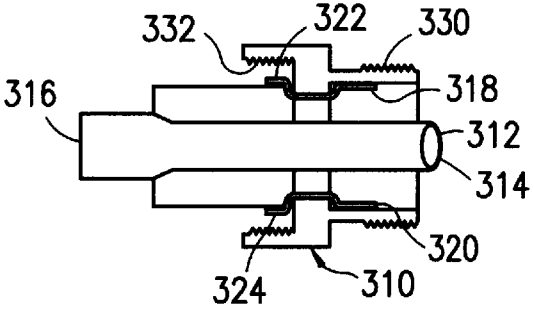
FIG. 16 diagrammatically illustrates a coupler or joining unit providing an interfit between the battery compartment segment and flashlight head segment thereby eliminating the flexible body element.
Figures 17A, 17B, 17C, 17D, 17E:
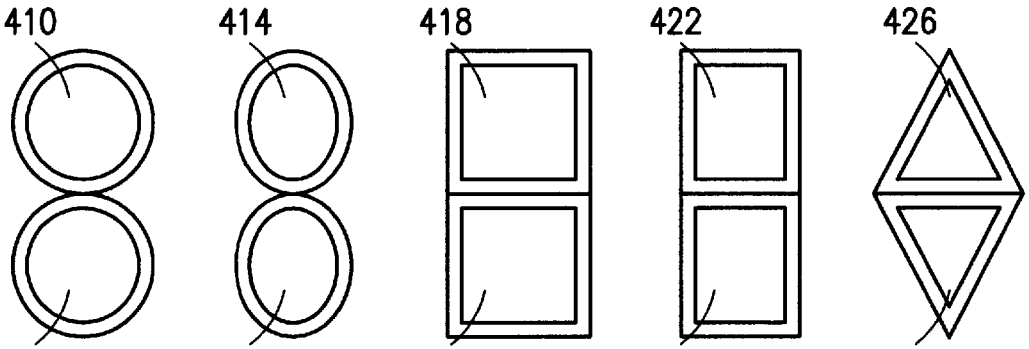
FIGS. 17*a*–17*e* diagrammatically illustrate various shapes of the flashlight lens.

In order to manufacture several versions of the twin headed flashlight, flexible body member 50 is meant to be omitted and, in its place, a short coupling 310, diagrammatically illustrated in FIG. 16, may be utilized. Short coupling 310 includes a central core conductor 312 with a conductor head 314 adapted to mate with contact 118 in flashlight head segment 56 (FIG. 11). The other end of conductor member 312 forms a contact surface 316 adapted to mate with contact 128 on battery compartment segment 58 (FIG. 12). Peripheral contacts 318, 320 are adapted to mate with contact prongs 114, 116 (FIG. 11). Contact prongs 322, 324 are adapted to mate with contact plates 122, 124 on battery compartment segment 58 (FIG. 12). Small coupler 310 has a male thread 330 and a female thread 332 adapted to mate with threads 110 on flashlight head segment 56 and threads 120 on battery compartment segment 58.

FIGS. 17*a*–17*e* diagrammatically illustrate various shapes of the first and second lenses which are at the light emitting ends of flashlight heads 12, 14. FIGS. 17*a*–17*e* show round shaped lenses 410, 412; elliptical, oval or ovoid shaped lenses 414, 416; square lenses 418, 420; rectangular lenses 422, 424; and triangular lenses 426, 428. Of course, the manufacturer may use a round lens with any other shaped lens, for example elliptical lens 416 or square lens 424. However, this use of different shaped lens may have an impact on the cost of manufacturing.

The claims appended hereto are meant to cover modifications and changes within the scope and spirit of the present invention.

What is claimed is:

1. A twin headed flashlight comprising:

a generally hollow, cylindrical body member having an axial centerline and having an interior body cavity sized to contain batteries to supply power to the flashlight;

a first, generally hollow, flashlight head element disposed at one end of said cylindrical body member, said first flashlight head including a first flashlight bulb disposed in an interior head cavity of said first flashlight head and including a first lens defining an outer end face of said first flashlight head, one edge of said first lens defining a first mating edge;

a second, generally hollow, flashlight head element rotatably disposed at said one end of said cylindrical body member, said second flashlight head including a second flashlight bulb disposed in a corresponding interior head cavity of said second flashlight head and including a second lens defining a corresponding outer end face of said second flashlight head, one edge of said second lens defining a second mating edge;

said first and second mating lens edges being complementary with respect to each other such that, in a first operative mode when said first and second mating lens edges are adjacent each other and upon generation of light by both said first and second bulbs, a single beam of light is emitted from said one end of said flashlight, and in a second operative mode when said second flashlight head is rotated outboard from said axial centerline of said cylindrical body member of said flashlight, two divergent beams of light are emitted from said flashlight;

a switch mounted on one of said cylindrical body member of said flashlight and said first flashlight head; and, an electrically conductive system coupling said batteries, said switch and said first and second flashlight bulbs together in an operative electrical circuit enabling activation of said first and second bulbs.

2. A twin headed flashlight as claimed in claim 1 wherein said first flashlight head element is disposed at a slight offset angle, not exceeding 10 degrees, from said axial centerline of said cylindrical body.

3. A twin headed flashlight as claimed in claim 1 wherein said flashlight includes a flexible body element disposed between said cylindrical body member and said first and second flashlight head elements, said flexible body element having two degrees of permissible motion.

4. A twin headed flashlight as claimed in claim 1 wherein said cylindrical body includes a first end to which is mounted said first and second flashlight head elements, and a second end; said flashlight including a hook member attached to said second end, said hook having a hook tongue which is substantially parallel to said axial centerline.

5. A twin headed flashlight as claimed in claim 1 wherein said cylindrical body includes a battery compartment segment and a flashlight head segment threadably attached to each other, said flashlight head segment carrying said switch thereon and providing a rotatable mount for said second flashlight head element.

6. A twin headed flashlight as claimed in claim 5 wherein said flashlight includes a flexible body element disposed between said battery compartment segment and said flashlight head segment, said flexible body element having two degrees of permissible motion.

7. A twin headed flashlight as claimed in claim 6 wherein said flexible body element is threadably attached to said battery segment and threadably attached to said flashlight head segment.

8. A twin headed flashlight as claimed in claim 2 wherein said second flashlight head element rotates at least 45 degrees outboard from said axial centerline.

9. A twin headed flashlight as claimed in claim 7 wherein said second flashlight head element rotates at least 45 degrees outboard from said axial centerline.

10. A twin headed flashlight as claimed in claim 3 wherein said flexible body element includes a plurality of ball and socket units permitting two degrees of motion over said flexible body element.

11. A twin headed flashlight as claimed in claim 9 wherein said flexible body element includes a plurality of ball and socket units permitting two degrees of motion over said flexible body element.

12. A twin headed flashlight comprising:

a generally hollow, cylindrical body member having an axial centerline and having an interior body cavity sized to contain batteries to supply power to the flashlight;

a first, generally hollow, flashlight head element disposed at one end of said cylindrical body member, said first flashlight head including a first flashlight bulb disposed in an interior head cavity of said first flashlight head and including a first lens defining an outer end face of said first flashlight head and having a first juxtaposed edge;

a second, generally hollow, flashlight head element rotatably disposed at said one end of said cylindrical body member, said second flashlight head including a second flashlight bulb disposed in a corresponding interior head cavity of said second flashlight head and including a second lens defining a corresponding outer end face of said second flashlight head and having a second juxtaposed edge;

said first and second juxtaposed lens edges being positioned adjacent each other in a first operative mode such that upon generation of light by both said first and second bulbs, a generally unitary, combinatory beam of light is emitted from said one end of said flashlight, and in a second operative mode when said second flashlight head is rotated outboard from said axial centerline of said cylindrical body member of said flashlight, two divergent beams of light are emitted from said flashlight;

a switch mounted on one of said cylindrical body member of said flashlight and said first flashlight head; and, an electrically conductive system coupling said batteries, said switch and said first and second flashlight bulbs together in an operative electrical circuit enabling activation of said first and second bulbs.

13. A twin headed flashlight as claimed in claim 12 wherein said first and second lenses has one lens shape from the group of a round lens, an elliptical lens, an ovoid lens with a singular straight edge, a square lens, a rectangular lens and a triangular lens.

14. A twin headed flashlight as claimed in claim 13 wherein said first flashlight head element is disposed at a slight offset angle, not exceeding 10 degrees, from said axial centerline of said cylindrical body.

15. A twin headed flashlight as claimed in claim 14 wherein said second flashlight head element rotates at least 45 degrees outboard from said axial centerline.

16. A twin headed flashlight as claimed in claim 15 wherein said flashlight includes a flexible body element disposed between said cylindrical body member and said first and second flashlight head elements, said flexible body element having two degrees of permissible motion.

17. A twin headed flashlight as claimed in claim 15 wherein said cylindrical body includes a battery compartment segment and a flashlight head segment threadably attached to each other, said flashlight head segment carrying said switch thereon and providing a rotatable mount for said second flashlight head element.

18. A twin headed flashlight as claimed in claim 17 wherein said flashlight includes a flexible body element disposed between said battery compartment segment and said flashlight head segment, said flexible body element having two degrees of permissible motion.

19. A twin headed flashlight as claimed in claim 18 wherein said flexible body element is threadably attached to said battery segment and threadably attached to said flashlight head segment.

20. A twin headed flashlight as claimed in claim 19 wherein said flexible body element includes a plurality of ball and socket units permitting two degrees of motion over said flexible body element.

* * * * *